United States Patent [19]

Dreisbach et al.

[11] Patent Number: 4,871,424

[45] **Date of Patent: * Oct. 3, 1989**

[54] PROCESS FOR CONTROLLING PITCH DEPOSITION FROM PULP IN PAPERMAKING SYSTEMS

[75] Inventors: David D. Dreisbach; Gilbert S. Gomes, both of Jacksonville, Fla.

[73] Assignee: Betz Laboratories, Inc., Trevose, Pa.

[ * ] Notice: The portion of the term of this patent subsequent to May 17, 2005 has been disclaimed.

[21] Appl. No.: 205,566

[22] Filed: Jun. 7, 1988

Related U.S. Application Data

[63] Continuation of Ser. No. 881,378, Jul. 2, 1986, abandoned.

[51] Int. Cl.[4] ..... D21H 3/44

[52] U.S. Cl. ..... 162/168.1; 162/168.2; 162/168.3; 162/199; 162/DIG. 4

[58] Field of Search ..... 162/DIG. 4, 72, 199, 162/168.1, 177, 168.2, 168.3; 252/351

[56] References Cited

U.S. PATENT DOCUMENTS

| | | | |
|---|---|---|---|
| 3,873,417 | 3/1975 | Otrhalek et al. | 162/DIG. 4 |
| 3,920,508 | 11/1975 | Yonemori | 162/157.5 |
| 3,920,509 | 11/1975 | Yonemori | 162/157.5 |
| 4,608,123 | 8/1986 | Leahy | 162/DIG. 4 |
| 4,744,865 | 5/1988 | Dreisbach et al. | 162/72 |

FOREIGN PATENT DOCUMENTS

| | | | |
|---|---|---|---|
| 43-5163 | 2/1968 | Japan | 162/DIG. 4 |
| 58-109698 | 6/1983 | Japan | 162/DIG. 4 |

*Primary Examiner*—Peter Chin

*Attorney, Agent, or Firm*—Alexander D. Ricci; Roslyn T. Tobe

[57] ABSTRACT

The invention relates to a process for controlling pitch deposition from pulp in papermaking systems which comprises adding to the pulp an effective amount of a polymer having hydroxyl groups pendant to the backbone of the polymer. The polymer can be polyvinyl alcohol having 50% to 100% hydrolysis. The polymer can also be a water-soluble copolymer having recurring units of nonionic hydrophilic monomers, and/or hydrophobic monomers, wherein the copolymer has at least 20 mol percent of vinyl alcohol. In another aspect, this invention comprises adding to the pulp an effective amount of a water-soluble polymer derived by substituting hydroxyl groups onto a preformed reactive polymer, wherein the water-soluble polymer has at least 20 mol percent of hydroxyl groups.

30 Claims, No Drawings

PROCESS FOR CONTROLLING PITCH DEPOSITION FROM PULP IN PAPERMAKING SYSTEMS

This is a continuation of co-pending application Ser. No. 881,378 filed on July 2, 1986, now abandoned.

BACKGROUND OF THE INVENTION

1. Field of the Invention

This invention relates to a process for controlling pitch deposition from pulp in papermaking systems.

2. Description of the Prior Art

Pitch deposition can be detrimental to efficient operation of paper mills. Pitch can deposit on process equipment in papermaking systems resulting in operational problems in the systems. Pitch deposits on consistency regulators and other instrument probes can render these components useless. Deposits on screens can reduce throughput and upset operation of the system. Deposition of the pitch can occur not only on metal surfaces in the system, but also on plastic and synthetic surfaces such as machining wires, felts, foils, uhle boxes and headbox components. Pitch deposits may also break off resulting in spots and defects in the final paper product which decrease the paper's quality.

Surfactants, anionic polymers and copolymers of anionic monomers and hydrophobic monomers have been used extensively to prevent pitch deposition of metal soap and other resinous pitch components. See "Pulp and Paper", by James P. Casey, Vol. II, 2nd edition, pp. 1096–7. Bentonite, talc, diatomaceous silica, starch, animal glue, gelatin and alum are known to reduce pitch trouble. U.S. Pat. No. 3,081,219, Drennen et al., discloses the use of a polymeric N-vinyl lactam to control pitch in the making of paper for sulfite pulps. U.S. Pat. No. 3,154,466, Nothum, discloses the use of xylene sulfonic acid-formaldehyde condensates and salts thereof as pitch dispersants in papermaking. The use of naphthalene sulfonic acid-formaldehyde condensates for pitch control is also known in the art. U.S. Pat. No. 3,582,461, Lipowski et al., teaches the use of water-soluble dicyandiamide-formaldehyde condensates to control pitch. U.S. Pat. No. 3,619,351, Kolosh, discloses process and composition for controlling resin in aqueous cellulose pulp suspensions which comprises incorporating in the suspension a resin control agent comprising a certain water-soluble nonsurface-active cationic quaternary ammonium salt.

Additionally, U.S. Pat. No. 3,748,220, Gard, discloses the use of an aqueous solution of nitrilotriacetic acid sodium salt and a water-soluble acrylic polymer to stabilize pitch in paper pulp. U.S. Pat. No. 3,992,249, Farley, discloses the use of certain anionic vinyl polymers carrying hydrophobic-oleophilic and anionic hydrophilic substituents when added prior to the beating operation in the range of about 0.5 part to 100 parts by weight of the polymer per million parts by weight of the fibrous suspension to inhibit the deposition of adhesive pitch particles on the surfaces of pulp-mill equipment. U.S. Pat. No. 4,184,912, Payton, discloses the use of a 3-component composition comprised of 50–20% by weight of a nonionic surfactant, 45–15% by weight of an anionic dispersant, and 45–15% by weight of an anionic polymer having molecular weight less than 100,000. U.S. Pat. No. 4,190,491, Drennen et al., discloses the use of a certain water-soluble linear cationic polymer having a viscosity average molecular weight of about 35,000 to 70,000. Also, U.S. Pat. No. 4,253,912, Becker et al., discloses the use of a certain soluble, chlorine-resistant phosphonate of high calcium tolerance to disperse pitch contained in the aqueous medium of a pulp or papermaking process.

SUMMARY OF THE INVENTION

This invention relates to a process for controlling pitch deposition from pulp in papermaking systems which comprises adding to the pulp an effective amount of a polymer having hydroxyl groups pendant to the backbone of the polymer. The polymer can be polyvinyl alcohol having 50% to 100% hydrolysis. The polymer can also be a water-soluble copolymer having recurring units of vinyl alcohol and recurring units of nonionic hydrophilic monomers, anionic hydrophilic monomers and/or hydrophobic monomers, wherein the copolymer has at least 20 mol percent of vinyl alcohol. In another aspect, this invention comprises adding to the pulp an effective amount of a water-soluble polymer derived by substituting hydroxyl groups onto a preformed reactive polymer, wherein the water-soluble polymer has at least 20 mol percent of hydroxyl groups.

There are several advantages associated with the present invention as compared to prior art processes. These advantages include: an ability to function without being affected by the hardness of the water used in the system unlike certain anionics; an ability to function with lower foaming than surfactants; and an ability to function while not adversely affecting sizing, fines retention, or pitch retention.

DETAILED DESCRIPTION OF THE INVENTION

The present inventors have discovered that pitch deposition from pulp in papermaking systems can be controlled by adding to the pulp an effective pitch deposition control amount of a polymer having hydroxyl groups pendant to the backbone of the polymer. By the term "pendant to the backbone", it is meant that the hydroxyl groups are attached to the main polymer chain only through the oxygen of the hydroxyl groups. Preferably, the polymer is water-soluble.

In one embodiment, the polymers of this invention are either polyvinyl alcohol having 50% to 100% hydrolysis being derived from polyvinyl acetate or water-soluble copolymers having recurring units of vinyl alcohol and recurring units of one or more nonionic hydrophilic, anionic hydrophilic and/or hydrophobic monomers, wherein the copolymer has at least 20 mol percent of vinyl alcohol. Preferably, the polymer has a molecular weight from about 1,000 to about 250,000.

Since vinyl alcohol is unstable with respect to isomerization to acetaldehyde, polymers of vinyl alcohol must be prepared by indirect methods. Therefore, the polymers of the instant invention can be derived or synthesized by polymerizing vinyl acetate to form polyvinyl acetate and alcoholysis or hydrolysis of the polyvinyl acetate to form polyvinyl alcohol. Preferably, the polyvinyl alcohol has a percent hydrolysis from about 70% to about 100%. The term "percent hydrolysis" is defined as the mole ratio of the hydroxyl groups to the starting acetate groups in the hydrolyzed polyvinyl acetate (polyvinyl alcohol) polymer multiplied by 100. Most preferably, the polyvinyl alcohol has a percent hydrolysis from about 85.5% to about 87%. It is further preferred that the polyvinyl alcohol has a molecular weight from about 1,000 to about 250,000 and, most preferably, from about 90,000 to about 150,000.

The polymers can also be water-soluble copolymers derived by polymerizing vinyl acetate with hydrophobic monomers and hydrolyzing the acetate partially or completely to form copolymers having recurring units of vinyl alcohol and recurring hydrophobic units, wherein the copolymer has at least 20 mol percent of vinyl alcohol units. Preferably, the copolymer has from about 0 mol percent to about 50 mol percent of recurring hydrophobic units. It is also preferred that the hydrophobic units of the copolymer are derived from monomers having from 2 to about 25 carbons. Exemplary hydrophobic monomers include vinyl acetate, propylene oxide, methacrylate, methyl ethacrylate, octadecylacrylate, n-octadecylacrylamide, styrene, methyl styrene, allyl stearate, vinyl stearate, ethene, propene, n-butene, isobutene, pentene, dodecene, octadecene, and vinyl ethers higher than methyl.

Additionally, the polymers of this invention can be water-soluble copolymers derived by polymerizing vinyl acetate with nonionic hydrophilic monomers and hydrolyzing the acetate partially or completely to form copolymers having recurring units of vinyl alcohol and recurring nonionic hydrophilic units, wherein the copolymer has at least 20 mol percent of vinyl alcohol units. The polymer can have from about 0 mol percent to about 80 mol percent of recurring hydrophilic units. Preferably, the copolymer has a vinyl alcohol mol percentage of greater than about 30%. Exemplary nonionic hydrophilic monomers include vinyl pyrrolidone, ethylene oxide, and acrylamide. Effective polymers in accordance with this invention can be comprised of both hydrophobic monomers and hydrophilic monomers, in combination with vinyl alcohol units. For example, the copolymer can have recurring units of vinyl alcohol, vinyl acetate, and vinyl pyrrolidone.

It is believed that effective copolymers of this invention can be formed having random distribution of the monomers, as well as various degrees of block formation and/or alternation within the polymer. By the term "block formation", it is meant that monomeric units of the same type tend to form regions in the polymer in exclusion of the other monomer. By the term "alternation", it is meant that the two monomers within the copolymer polymerize in such a manner that every other monomeric unit in the polymer is the same.

In another embodiment, the polymers of this invention are water-soluble polymers derived by substituting hydroxyl groups onto a preformed or pre-existing reactive polymer wherein the water-soluble polymer has from 20% to 100% of the available reactive groups of the preformed or pre-existing polymer substituted to be or remaining as hydroxyl groups so that the water-soluble polymer has at least 20 mol percent of hydroxyl groups. The term "preformed" or "pre-existing reactive polymer" means a polymer of either synthetic or natural origin which may be reacted to add hydroxyl groups to its structure or to allow previously existing hydroxyl groups to remain in its structure via methods known to those skilled in the art. Examples of suitable preformed reactive polymers include polyvinyl acetate, cellulose, and various carbohydrates such as starch, galatomanan, galactoglucomanan, xylan, arabinogalactan and chitan. "Available reactive groups" means any group on a preformed reactive polymer which may be used to incorporate hydroxyl groups into the polymer via reaction mechanisms known to those skilled in the art.

The available reactive groups of the preformed polymer can also be substituted with other hydrophilic and/or hydrophobic groups which allow for water solubility of the polymer. The polymer can be derived by substituting hydrophobic groups along with the hydroxyl groups onto a suitable preformed reactive polymer to form a water-soluble polymer having from about 0 mol percent to about 50 mol percent of the available reactive groups substituted with hydrophobic groups. For example, the polymer can be hydroxypropylcellulose. Preferably, the hydrophobic groups have from 2 to about 25 carbons and are linked to the polymer by ether, ester, amine, amide, carbon-carbon or other suitable bond types. Preferred hydrophobic groups include: hydroxypropyl, hydroxybutyl, acetate, and ethers and esters having 2 to 16 carbons. Similarly, the polymer can be derived by substituting hydrophilic groups along with the hydroxyl groups onto a suitable preformed reactive polymer to form a water-soluble polymer having from about 0 mol percent to about 80 mol percent of the available reactive groups substituted with hydrophilic groups. For example, suitable polymers include hydroxyethylcellulose, methylcellulose. Preferred hydrophilic groups include hydroxyl, carboxyl, sulfonic, pyrrolidone, ethoxy, amide and polyethoxylate groups. It is further believed that the polymers of this invention having hydroxyl groups pendant to the backbone may have both hydrophobic and hydrophilic substitutions in the same polymer and still be effective for controlling pitch deposition. Examples of such polymers include hydroxypropyl methylcellulose and hydroxybutyl methylcellulose.

The polymers of the instant invention are effective in controlling pitch deposition in papermaking systems, such as Kraft, acid sulfite, and groundwood papermaking systems. For example, pitch deposition in the brown stock washer, screen room and decker systems in Kraft papermaking processes can be controlled. The term "papermaking system" is meant to include all pulp processes. Generally, it is thought that these polymers can be utilized to prevent pitch deposition on all wetted surfaces from the pulp mill to the reel of the paper machine under a variety of pH's and conditions. More specifically, these polymers effectively decrease the deposition of metal soap and other resinous pitch components not only on metal surfaces, but also on plastic and synthetic surfaces such as machine wires, felts, foils, uhle boxes and headbox components. The polymers of this invention are also effective in preventing deposition of the ethylene bis stearamide (EBS) components of defoamers. EBS frequently shows up as a major component of pitch-like deposits from the pulp mill to the reel of the paper machine.

The polymers of the present invention can be added to the pulp at any stage of the papermaking system. The polymers can be added in dry particulate form or as a dilute aqueous solution. The effective amount of these polymers to be added depends on the severity of the pitch problem which often depends on a number of variables, including the pH of the system, hardness, temperature, and the pitch content of the pulp. Generally between 0.5 ppm and 150 ppm of the polymer is added based on the weight of the pulp slurry.

The invention will be further illustrated by the following examples which are included as being illustrations of the invention and should not be construed as limiting the scope thereof.

EXAMPLES

It was found that pitch could be made to deposit from a 0.5% consistency fiber slurry containing approximately 2000 ppm of a laboratory pitch by placing the slurry into a metal pan suspended in a laboratory ultrasonic cleaner water bath. The slurry contained 0.5% bleached hardwood kraft fiber, approximately 2000 ppm of a fatty acid blend as the potassium salt, approximately 500 ppm calcium expressed as calcium carbonate from calcium chloride and approximately 300 ppm sodium carbonate. The slurry was maintained at 50° C. and a pH of 11.0. It was stirred gently by an overhead stirrer and subjected to ultrasonic energy for 10 minutes. The deposit was determined by the difference between the starting weight of the metal pan and the oven dried weight of the pan plus the deposit after the completion of test. Results are reported in Table I.

TABLE I

| Treatment | Deposit Weight |
|---|---|
| Control | 686 mg |
| 50 ppm Polyvinyl alcohol, 85.5–87% hydrolyzed; 10,000 MW | 101 mg |
| 50 ppm Polyvinyl alcohol, 85.5–87% hydrolyzed; 96,000 MW | 33 mg |
| 50 ppm Polyvinyl alcohol, 85.4–87% hydrolyzed; 125,000 MW | 23 mg |
| 50 ppm Polyvinyl alcohol, 72.9% hydrolyzed; 2,000 MW | 60 mg |
| 50 ppm Polyvinyl alcohol, 77% hydrolyzed; 3,000 MW | 81 mg |
| 50 ppm Hydroxypropyl Methylcellulose, 15 milipascal-seconds 2% solution at 20° C., 10,000 MW | 22 mg |
| 50 ppm Methylcellulose, 15 milipascal-seconds 2% solution at 20° C., 10,000 MW | 26 mg |
| 50 ppm Methylcellulose, 1500 milipascal-seconds 2% solution at 20° C., 63,000 MW | 1 mg |
| 50 ppm Methylcellulose, 4000 milipascal-seconds 2% solution at 20° C., 86,000 MW | 0 mg |

The results shown in Table I demonstrate that polymers in accordance with this invention are effective in controlling pitch deposits from pulp in a test designed to simulate brown stock washer/screen room Kraft pitch deposition. These results further indicate that the polymers are effective in controlling pitch deposition on metal surfaces and under alkaline conditions.

Additionally it was found that pitch having a composition similar to that of Southern pine extractables could be made to deposit from a 0.5% consistency pulp slurry containing 350 ppm pitch onto a plastic surface by stirring the slurry at a high rate using a blender. The slurry contained 0.5% bleached hardwood Kraft fiber, approximately 350 ppm pitch having fatty acids, resin acids, fatty esters and sterols in the approximate ratio of Southern pine resin and 200 ppm calcium expressed as calcium derived from calcium chloride. The slurry was maintained at a pH of 4.0. A plastic coupon was fashioned and attached to the metal blender base. The pulp slurry was added to the blender and stirred for 5 minutes. The plastic coupon was then air dried and the deposit was determined by the difference between the clean and deposit laden weight of the plastic coupon. The results are reported in Table II.

TABLE II

| Treatment | *% Control of Deposit |
|---|---|
| 10 ppm Polyvinyl Alcohol, 85.5–87% hydrolyzed; 10,000 MW | 67% |
| 10 ppm Polyvinyl Alcohol, 85.5–87% hydrolyzed; 125,000 MW | 88% |
| 10 ppm Polyvinyl Alcohol, 77% hydrolyzed; 2,000 MW | 26% |
| 10 ppm Polyvinyl Alcohol, 77% hydrolyzed; 3,000 MW | 41% |
| 10 ppm Polyvinyl Alcohol, 99% hydrolyzed; 96,000 MW | 57% |
| 10 ppm Polyvinyl Pyrrolidone:Polyvinyl Acetate: Polyvinyl Alcohol Copolymer (30:50:20 ratio) | 61% |
| 10 ppm Polyvinyl Pyrrolidone:Polyvinyl Acetate: Polyvinyl Alcohol Copolymer (30:30:40 ratio) | 59% |
| 10 ppm Fully Hydrolyzed Airflex 400*** | 73% |
| 10 ppm Fully Hydrolyzed Airflex 300*** | 50% |
| 1 ppm Methylcellulose, 15 milipascal-seconds 2% solution at 20° C., 10,000 MW | 88% |
| 1 ppm Methylcellulose, 4,000 milipascal-seconds 2% solution at 20° C., 86,000 MW | 93% |
| 1 ppm Hydroxypropylmethylcellulose, 5 milipascal-seconds 2% solution at 20° C., 5,000 MW | 74% |
| 1 ppm Hydroxypropylmethylcellulose, 4,000 milipascal-seconds 2% solution at 20° C., 86,000 MW | 85% |
| 1 ppm Hydroxybutylmethylcellulose, 100 milipascal-seconds 2% solution at 20° C., 26,000 MW | 88% |
| 1 ppm Hydroxyethylcellulose, 81,000 MW, 2.5 molar substitution** | 49% |
| 1 ppm Hydroxypropylcellulose $1.0 \times 10^6$ MW, 3.0 molar substitution** | 36% |

$$*\% \text{ Control of deposit} = \frac{(\text{Untreated wt.}) - (\text{Treated wt.})}{(\text{Untreated wt.})} \times 100$$

**Molar Substitution = moles of substitution groups or agents per anhydroglucose unit.

***Airflex 300 and Airflex 400 are vinyl acetate/ethylene copolymers available from Air Products and Chemicals, Inc.

The results reported in Table II indicate that polymers of this invention are effective in preventing pitch deposition on plastic surfaces. These results further indicate that the polymers may be effectively utilized under acidic conditions which might occur during any acid fine, linerboard, and groundwood papermaking operation.

It was also found that the ethylene bis stearamide (EBS) fraction of typical brown stock wash aids could be made to deposit from a pulp slurry using the above-described procedure for Southern pine pulp and substituting 1500 ppm of an EBS containing brown stock defoamer for the pitch components. The results are reported in Table III.

TABLE III

| Treatment | Deposit Weight |
|---|---|
| Control | 4.5 mg |
| 50 ppm Polyvinyl Alcohol, 85.5–87% hydrolyzed, 125,000 MW | 0.6 mg |
| 50 ppm Methylcellulose, 1,500 milipascal-seconds 2% solution at 20° C., 63,000 MW | 0.2 mg |

The results reported in Table III indicate that polymers of this invention are effective in preventing deposition of deposition-prone EBS components of defoamers.

Tests were also conducted to study pitch retention. The pitch solution and fiber for addition were prepared as described in the procedure for Table I. However, rather than using an ultrasound, the diluted slurry was added to a beaker. A stirrer was then connected and the contents stirred for 10 minutes. Then the slurry was dumped from the beaker into a Buchner funnel with machine wire in the bottom. Water was allowed to drain under gravity and then the full vacuum was pulled on the pulp pad. The pad was soxhlet extracted to determine the soluble organic content. Results are reported in Table IV.

TABLE IV

| Treatment | % Soluble Organics in Pulp Pad |
|---|---|
| Set A | |
| Control 1 (untreated) | 3.2% |
| Control 2 (untreated) | 3.0% |
| Polyvinyl alcohol, 85.5–87% hydrolyzed; 125,000 MW | 26.0% |
| Methylcellulose, 1500 milipascal-seconds | 19.0% |
| Polyacrylic acid, 243,000 MW | 2.5% |
| Set B | |
| Control | 1.9% |
| Polyvinyl alcohol, 85.5–87% hydrolyzed; 10,000 MW | 4.0% |
| Polyvinyl alcohol, 72.9% hydrolyzed; 2,000 MW | 2.2% |
| Polyvinyl alcohol, 77% hydrolyzed; 3,000 MW | 1.8% |
| Methylcellulose, 15 milipascal-seconds | 26.0% |
| Hydroxypropyl Methylcellulose, 15 milipascal-seconds | 21.0% |
| Methylcellulose, 15 milipascal-seconds | 26.0% |

The results reported in Table IV indicate that higher molecular weight polyvinyl alcohols, such as 125,000 MW, and water-soluble cellulose polymers in accordance with this invention flocculate and retain pitch, and that lower molecular weight polyvinyl alcohols have little negative effect on pitch retention.

A Kraft pitch-control trial was conducted at a Southern bleached Kraft mill experiencing severe disposition conditions in the screen room. These trials involved feeding product to the brown stock or screen room/-decker area and monitoring deposit control by the weight of deposit scraped daily from a steel plate at a point downstream. Results are reported in Table V.

TABLE V

| Trial Treatment Method (Time Period) | *Pre-Trial Baseline (Range/Ave) | *Trial Data (Range/Ave) | *Post-Trial Baseline (Range/Ave) | % Control By Treatment |
|---|---|---|---|---|
| **Custom Sperse ® 1035 (10/16–11/26/84) | 28.9–57.5/ 35 | 7.2–55.3/ 26.9 | Not Available | 23% |
| Polyvinyl Alcohol; 125,000 MW; 85% hydrolyzed (9/10–10/4/85) | 26.5–70.9/ 36.7 | 3.1–7.2/ 5.7 | 12.4–31.3/ 17.2 | 79% |

*Numbers represent grams of pitch deposited in a 24 hour period and scraped from a stationary stainless steel surface submerged in a pulp stream. (Pitch plate.)

**Proprietary blend of surfactants and dispersants available from Betz PaperChem, Inc.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for controlling pitch deposition from pulp in papermaking systems comprising adding to the pulp an effective amount of a water-soluble polyvinyl alcohol having 50% to 100% hydrolysis.

2. The process of claim 1 wherein the polyvinyl alcohol has a molecular weight of from about 1,000 to about 250,000.

3. The process of claim 1 wherein the polyvinyl alcohol has a percent hydrolysis from 70% to about 100%.

4. The process of claim 3 wherein the polyvinyl alcohol has a molecular weight from about 1,000 to about 250,000.

5. The process of claim 4 wherein the polyvinyl alcohol has a molecular weight from 90,000 to 150,000.

6. The process of claim 5 wherein the polyvinyl alcohol has a percent hydrolysis from about 85.5% to about 87%.

7. The process of claim 6 wherein the polyvinyl alcohol has a molecular weight of about 125,000.

8. A process for controlling pitch deposition from pulp in papermaking systems comprising adding to pulp an effective amount of a water-soluble copolymer having recurring units of vinyl alcohol and one or more recurring nonionic hydrophilic units, wherein the copolymer has at least 20 mol percent vinyl alcohol units.

9. The process of claim 8 wherein the copolymer has a vinyl alcohol mol percentage of greater than about 30%.

10. A process for controlling pitch deposition from pulp in papermaking systems comprising adding to the pulp an effective amount of a water-soluble copolymer having recurring units of vinyl alcohol and one or more recurring hydrophobic units, wherein the copolymer has at least 20 mol percent of vinyl alcohol units.

11. The process of claim 10 wherein the copolymer has from about 1 mol percent to about 50 mol percent of recurring hydrophobic units.

12. The process of claim 11 wherein the hydrophobic units are derived from monomers having from 2 to about 25 carbons.

13. The process of claim 10 wherein the hydrophobic units are ethene.

14. The process of claim 10 wherein the copolymer further has one or more recurring nonionic hydrophilic units wherein said nonionic hydrophilic units are selected from the group consisting of vinyl pyrrolidone, ethylene oxide, and acrylamide.

15. The process of claim 14 wherein the hydrophobic units are vinyl acetate and the nonionic hydrophilic units are vinyl pyrrolidone.

16. A process for controlling pitch deposition from pulp in papermaking systems comprising adding to pulp an effective amount of a composition consisting essentially of a water-soluble copolymer having recurring units of vinyl alcohol and one or more recurring nonionic hydrophilic units, wherein the copolymer has at least 20 mol percent vinyl alcohol units.

17. The process of claim 16 wherein the copolymer has a vinyl alcohol mol percentage of greater than about 30%.

18. A process for controlling pitch deposition from pulp in papermaking systems comprising adding to the pulp an effective amount of a composition consisting essentially of a water-soluble copolymer having recurring units of vinyl alcohol and one or more recurring hydrophobic units, wherein the copolymer has at least 20 mol percent of vinyl alcohol units.

19. The process of claim 18 wherein the copolymer has from about 1 mol percent to about 50 mol percent of recurring hydrophobic units.

20. The process of claim 19 wherein the hydrophobic units are derived from monomers having from 2 to about 25 carbons.

21. The process of claim 18 wherein the hydrophobic units are ethene.

22. The process of claim 18 wherein the copolymer further has one or more recurring nonionic hydrophilic units wherein said nonionic hydrophilic units are selected from the group consisting of vinyl pyrrolidone, ethylene oxide, and acrylamide.

23. The process of claim 22 wherein the hydrophobic units are vinyl acetate and the nonionic hydrophilic units are vinyl pyrrolidone.

24. A process for controlling pitch deposition from pulp in papermaking systems comprising adding to the pulp and effective amount of a composition consisting essentially of a water-soluble polyvinyl alcohol having 50% to 100% hydrolysis.

25. The process of claim 24 wherein the polyvinyl alcohol has a molecular weight from about 1,000 to about 250,000.

26. The process of claim 24 wherein the polyvinyl alcohol has a percent hydrolysis from about 70% to about 100%.

27. The process of claim 26 wherein the polyvinyl alcohol has a molecular weight from about 1,000 to about 250,000.

28. The process of claim 27 wherein the polyvinyl alcohol has a molecular weight from 90,000 to 150,000.

29. The process of claim 28 wherein the polyvinyl alcohol has a percent hydrolysis from about 85.5% to about 87%.

30. The process of claim 29 wherein the polyvinyl alcohol has a molecular weight of about 125,000.

* * * * *